US007498750B2

(12) United States Patent
Van Der Voort et al.

(10) Patent No.: US 7,498,750 B2
(45) Date of Patent: Mar. 3, 2009

(54) GAS DISCHARGE LAMP DRIVING CIRCUIT AND METHOD WITH RESONATING SWEEP VOLTAGE

(75) Inventors: Ronald Hans Van Der Voort, Eindhoven (NL); Oscar Jan Deurloo, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 91 days.

(21) Appl. No.: 11/570,511

(22) PCT Filed: Jun. 9, 2005

(86) PCT No.: PCT/IB2005/051903

§ 371 (c)(1),
(2), (4) Date: Dec. 13, 2006

(87) PCT Pub. No.: WO02/17052

PCT Pub. Date: Feb. 28, 2002

(65) Prior Publication Data

US 2008/0007184 A1 Jan. 10, 2008

(30) Foreign Application Priority Data

Jun. 21, 2004 (EP) ..... 04102830

(51) Int. Cl.
*H05B 37/02* (2006.01)

(52) U.S. Cl. ..... 315/209 R; 315/224; 315/225; 315/307; 315/200 S

(58) Field of Classification Search ..... 315/224, 315/225, 209 R, 200 S, 219, 291, 307
See application file for complete search history.

(56) References Cited

U.S. PATENT DOCUMENTS

| | | | |
|---|---|---|---|
| 4,862,040 | A | 8/1989 | Nilssen |
| 4,918,663 | A | 4/1990 | Remington et al. |
| 5,021,679 | A | 6/1991 | Fairbankis et al. |
| 5,189,647 | A | 2/1993 | Suzuki et al. |

(Continued)

FOREIGN PATENT DOCUMENTS

| | | | |
|---|---|---|---|
| EP | 0831389 | A2 | 3/1998 |

(Continued)

OTHER PUBLICATIONS

Wei Chen et al; "An Improved"Charge Pump" Electroniic Ballast With Low THD and Low Crest Factor", Virginia Power Electronics Center, The Bradley Dept. of Electrical Eng. Virginia Polytechnic Inst. and State Univ. Blacksburg, VA., pp. 622-627, 1996 IEEE.

*Primary Examiner*—Tuyet Vo

(57) ABSTRACT

A gas discharge lamp is driven using a high frequency lamp current. A lamp driving circuit comprises a high frequency bridge circuit for supplying said lamp current. To prevent the lamp from extinguishing, when the lamp voltage is lower than a predetermined lamp operation voltage, a resonant circuit is provided in the lamp driving circuit between the lamp and the high frequency bridge circuit. The frequency of the bridge circuit is selected such that the resonant circuit may resonate to sweep up the voltage supplied to the gas discharge lamp to a voltage higher than said lamp operation voltage.

9 Claims, 4 Drawing Sheets

U.S. PATENT DOCUMENTS

Figure 1:
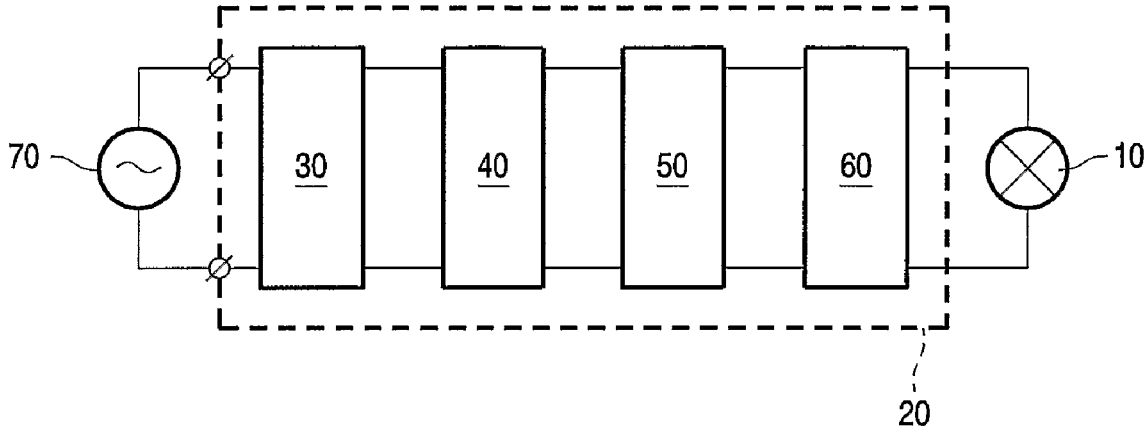

| | | | | |
|---|---|---|---|---|
| 5,630,148 | A | 5/1997 | Norris | |
| 5,825,674 | A | 10/1998 | Jckson | |
| 6,040,661 | A | 3/2000 | Bogdan | |
| 6,072,283 | A | 6/2000 | Hedrei et al. | |
| 6,127,816 | A | 10/2000 | Hirst | |
| 6,194,840 | B1 | 2/2001 | Chang | |
| 6,195,753 | B1 | 2/2001 | Nakamura | |
| 6,459,214 | B1 | 10/2002 | Chen et al. | |
| 6,657,401 | B2 * | 12/2003 | Kominami et al. | 315/291 |
| 6,756,746 | B2 * | 6/2004 | Nerone et al. | 315/291 |
| 2002/0117971 | A1 * | 8/2002 | Ito et al. | 315/219 |
| 2002/0190752 | A1 | 12/2002 | Takahashi et al. | |
| 2003/0122504 | A1 | 7/2003 | Rudolph et al. | |
| 2004/0027910 | A1 | 2/2004 | Bae et al. | |
| 2006/0038513 | A1 * | 2/2006 | Henry | 315/291 |

FOREIGN PATENT DOCUMENTS

| | | | |
|---|---|---|---|
| JP | 2001126894 | A | 5/2001 |
| WO | 0217052 | A2 | 2/2002 |
| WO | 0229893 | A1 | 4/2002 |

* cited by examiner

GAS DISCHARGE LAMP DRIVING CIRCUIT AND METHOD WITH RESONATING SWEEP VOLTAGE

The present invention relates to driving a gas discharge lamp, in particular a high intensity gas discharge (HID) lamp. In particular, the present invention relates to a gas discharge lamp driving method and to a single stage gas discharge lamp driving circuit having a high power factor.

A lamp driving circuit is needed to supply a gas discharge lamp, in particular a High Intensity Discharge (HID) lamp with a suitable voltage (and current) in order to enable the lamp to function. In order to ignite the lamp, an ignition voltage is needed, and a predetermined operation voltage and current are needed to keep the lamp on.

Gas discharge lamp driving circuits and in particular high intensity gas discharge lamp driving circuits are known in the art and are used, for example, with discharge lamps to be powered by an AC mains voltage.

It is known to convert the supplied AC voltage to a DC voltage and provide said DC voltage to a rapidly switching bridge circuit to generate a high frequency AC voltage, thus for example providing a high frequency square wave voltage. To provide said DC voltage, the AC supply voltage is rectified by the lamp driving circuit before being supplied to said bridge circuit. Using such a driving circuit has a disadvantage that supplied energy is dissipated by the driving circuit, thus deteriorating driving circuit efficiency.

Certain known lamp driving circuit designs, and corresponding lamp driving methods, comprise a power factor correction stage. Such a power factor correction stage however dissipates energy itself and thus decreases the driving circuit efficiency.

Other known driving circuit designs aim to eliminate the power factor correction stage. In "An improved charge pump electronic ballast with low thd and low crest factor" by W. Chen and F. Lee, APEC 1996, a single stage converter with power feedback is proposed. Such a driving circuit only achieves a low total harmonic distortion (THD) under predetermined conditions. To achieve said predetermined conditions, the driving circuit becomes complex. Such complex driving circuits are expensive and are sensitive to malfunctioning. Further, in the above mentioned single stage converter, energy storage is necessary. Such energy storage requires large components, giving a large driving circuit. Said large energy storage components are also very sensitive to malfunctioning.

It is an object of the present invention to provide an efficient and simple, low-cost gas discharge lamp driving method and driving circuit without energy storage.

The above-mentioned object is achieved in a method for driving a gas discharge lamp according to claim 1 and in a gas discharge lamp driving circuit according to claim 5.

In the method according to the present invention an AC voltage is rectified to a DC voltage varying like a half-sine wave from zero to the maximum voltage of the AC voltage, the half-sine wave voltage having a frequency that is double the frequency of the AC supply voltage.

The voltage supplied to the lamp may drop below the operating voltage. The DC voltage is not converted to a DC voltage having little or no ripple. Therefore, there is no substantial energy storage necessary in the lamp driving circuit for compensating a periodical drop in the DC voltage.

The high frequency half bridge of the driving circuit according to the present invention is controlled by a control circuit to output a high frequency voltage. Said high frequency voltage is supplied to a discharge lamp such as a gas discharge lamp. The high frequency bridge output voltage however becomes periodically lower than the above-mentioned predetermined operating voltage. Therefore, in the method and driving circuit according to the present invention, a resonant circuit is provided in the load circuit. Said resonant circuit prevents that the HID lamp extinguishes each time the bridge output voltage becomes lower than said operation voltage, as is described in more detail below.

The driving circuit and in particular the resonant circuit thereof is designed such that, when the bridge output voltage drops, the voltage over the resonant circuit increases and supplies the (re-) ignition voltage to the lamp to ensure that the lamp does not extinguish.

The lamp driving circuit according to the present invention may be provided with a low-pass input filter to filter high frequency parts from the supplied AC voltage, in particular a mains voltage. Also, high frequencies generated in the driving circuit, such as higher order harmonics of a base frequency and any high frequency noise signals, may disturb the mains circuit. The input filter may also prevent that high frequency signals generated in the driving circuit are transferred to the mains circuit.

In order to ignite the gas discharge lamp, the frequency of the bridge output voltage may be swept downwards to the resonance frequency of the resonant circuit, or a harmonic thereof, to sweep up the voltage supplied to the gas discharge lamp. Thus, a high voltage may be supplied to the lamp, which is needed to ignite the lamp, without a need for additional ignition circuitry.

During operation of the lamp driving circuit, the resonance frequency may be a first or higher order harmonic of the frequency of the supply voltage output by the bridge circuit. Selecting the resonance frequency and the bridge output voltage frequency having such a relation ensures that the resonant circuit sweeps up the voltage over the lamp, since, when the voltage output by the bridge circuit drops, the impedance of the lamp increases. Due to said increase of the lamp impedance, the damping of the resonant circuit becomes less and the voltage over the resonant circuit sweeps up.

If the resonance frequency is a higher order harmonic, it is preferably an odd higher order harmonic. Since the bridge output voltage is substantially a high frequency square wave, it is composed of a series of odd higher order harmonic sine waves of the base frequency of said square wave, which is derivable by Fourier analysis of the square wave. The square wave will therefore be suitable for generating a resonance in the resonant circuit, if the resonance frequency is an odd higher order harmonic of the base frequency of the square wave.

In an embodiment, the lamp circuit comprises a parallel circuit of the gas discharge lamp and a first resonator capacitance, which parallel circuit is connected in series with an inductance, the first resonator capacitance and the inductance being part of said resonant circuit. As described above, when the supply voltage output by the bridge circuit drops, the lamp impedance increases and the damping of the lamp circuit becomes less. In this simple embodiment, the voltage over the first resonator capacitance increases as a result and thus the voltage over the parallel circuit including the lamp increases. The increased voltage over said parallel circuit prevents that the lamp extinguishes.

In a further embodiment, a second resonator capacitance is connected in series with said inductance and said parallel circuit. Addition of a second resonator capacitance enables to decrease the value of the first resonator capacitance. With a smaller first resonator capacitance, less current is needed to generate the (re-) ignition voltage. Additional measures may be taken to improve the power factor. For example, frequency modulation of the half bridge frequency may shape the input current such that the power factor increases.

The low-pass input filter may comprise a first input filter capacitance, an input filter transformer, and a second input filter capacitance. In such an embodiment of the input filter, the first input filter capacitance may be connected between a first and a second input terminal of the input filter and the second input filter capacitance may be connected between a first and a second output terminal of the input filter. A first winding of the input filter transformer may be connected between the first input terminal and the first output terminal of the input filter. A second winding of the input filter transformer may be connected between the second input terminal and the second output terminal of the input filter. Such an input filter is an EMI filter, which is a filter type known in the art for preventing that high frequent signals are communicated between two separate circuits, in this case for example a mains circuit and a lamp driving circuit.

Figure 2:
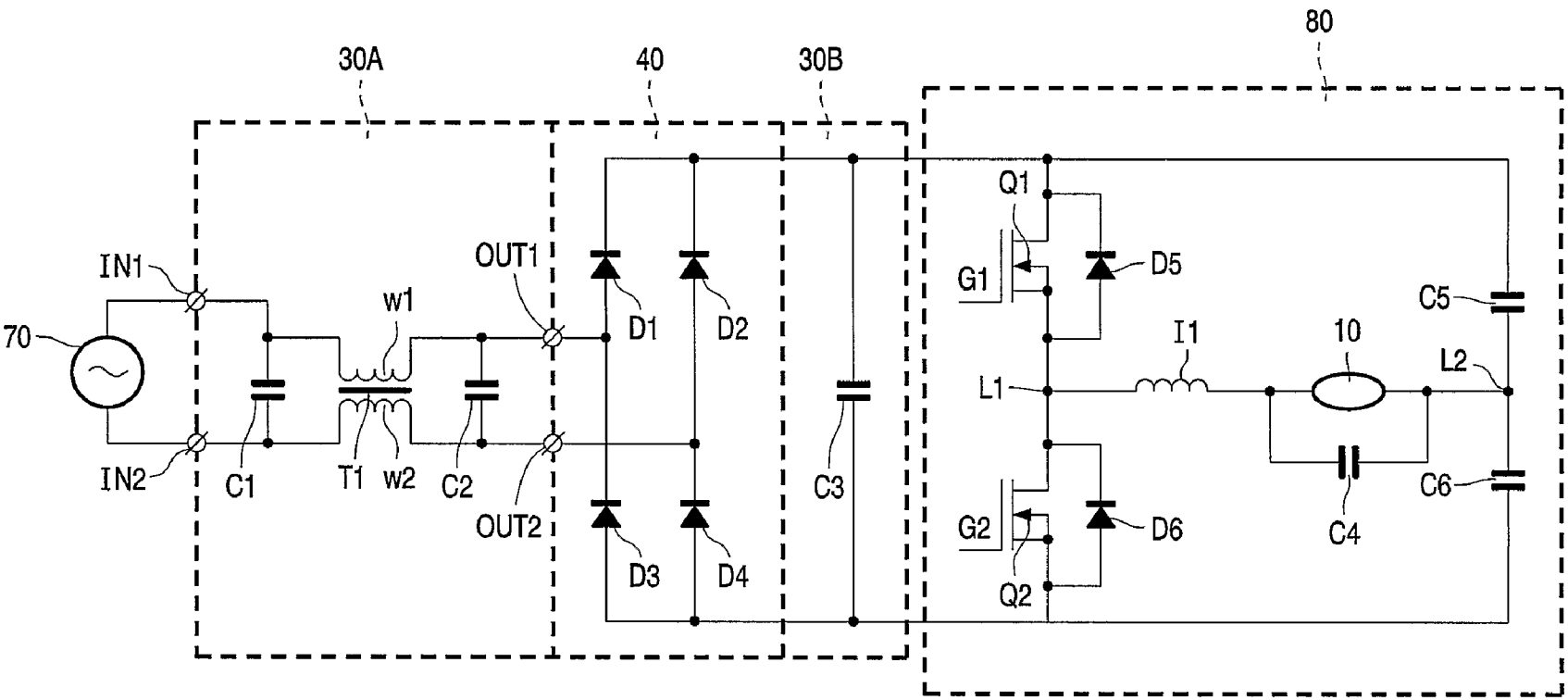
Figure 3A:
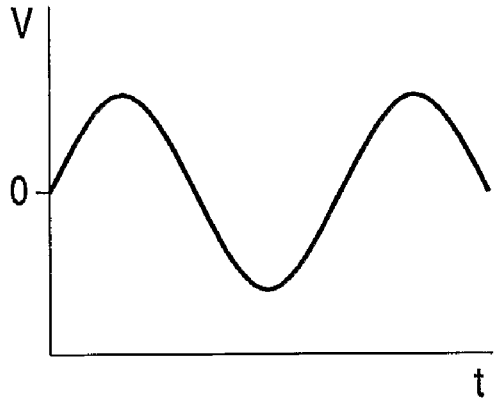
Figure 3B:
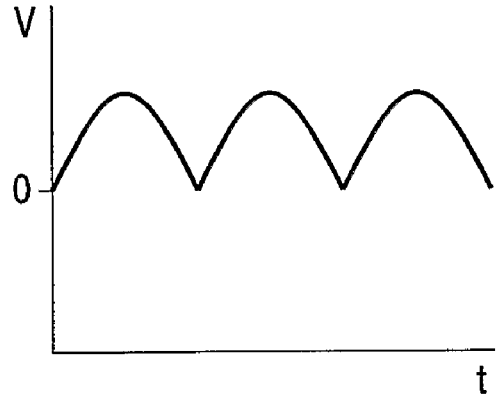
Figure 3C:
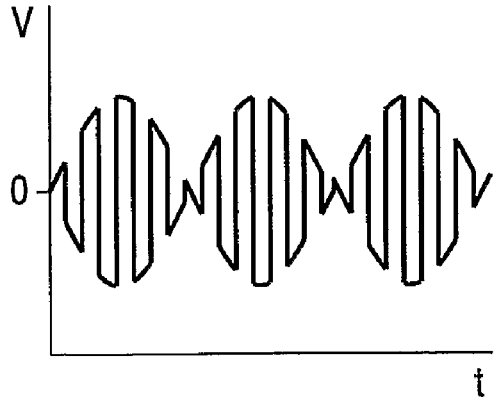
Figure 4:
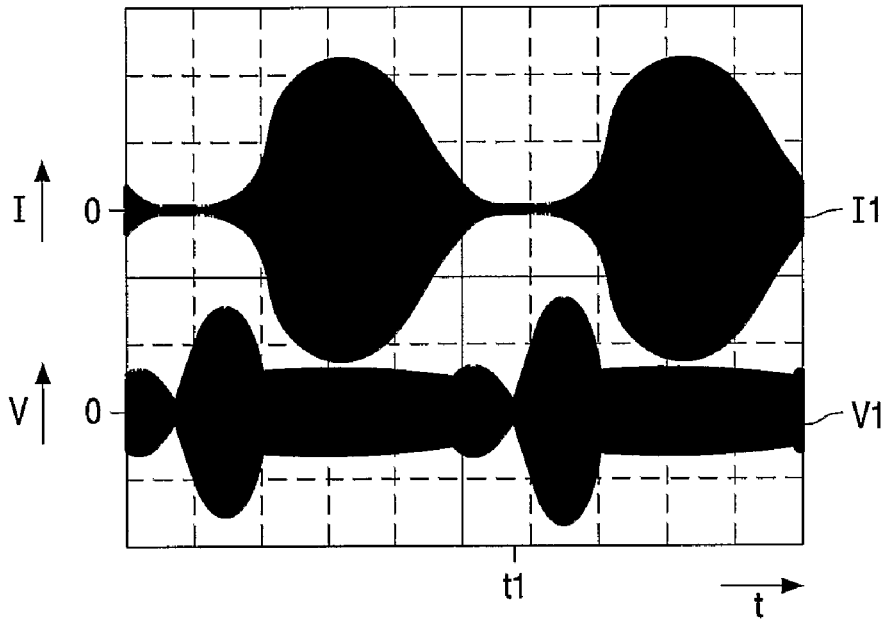
Figure 5:
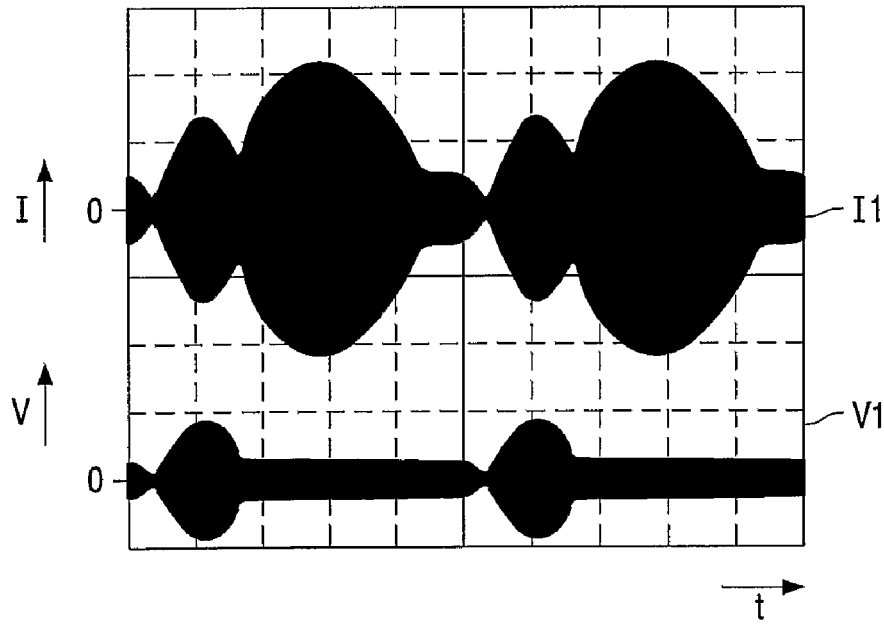

Hereinafter the present invention will be illustrated in more detail with reference to the annexed drawings showing non-limiting exemplary embodiments, wherein FIG. 1 schematically illustrates a gas discharge lamp driving circuit according to the present invention;

FIG. 2 shows a circuit diagram of an embodiment of the gas discharge lamp driving circuit according to the present invention;

FIG. 3A-3C schematically illustrate the voltage output by an AC voltage source, the input filter, the rectifier circuit and the half-bridge circuit, respectively;

FIG. 4 shows a lamp current and a lamp voltage in an embodiment of the present invention; and FIG. 5 shows an inductance current and a lamp voltage in an embodiment of the present invention.

FIG. 1 schematically illustrates a gas discharge lamp driving circuit 20 and a gas discharge lamp 10 connected thereto. The lamp driving circuit 20 is further connected to an AC voltage source 70, for example a mains voltage alternating with a frequency of 50 HZ or 60 Hz.

The lamp 20 comprises an input filter 30, a rectifier circuit 40 and a half-bridge circuit 50. The lamp 10 is connected to a resonant circuit 60, which together with the gas discharge lamp 10 forms a load circuit for the half-bridge circuit 50. The lamp driving circuit 20 according to the present invention does not comprise any energy storage circuit or any power factor correction circuit.

The AC voltage supplied by the voltage source 70 is filtered by the input filter 30. The input filter 30 is a low-pass filter, for example an electromagnetic interference (EMI) filter, well known in the art, for filtering high frequency signals from the input voltage and possibly for preventing that high frequency signals are transferred to the AC voltage source 70 like a mains voltage source.

The rectifier circuit 40 receives a filtered AC voltage from the input filter 30 and rectifies said voltage. The rectifier circuit 40 may be a well-known full-diode bridge circuit, but may as well be any other active or passive rectifier circuit. The rectifier 40 does not remove any ripple from the DC voltage, and therefore no energy storage is required.

Since the AC voltage is rectified without removing any ripple, the resulting DC voltage varies from a maximum voltage to zero with a frequency that is double the frequency of the supplied voltage, for example 100 Hz if a 50 Hz mains voltage is supplied by the voltage source 70. The gas discharge lamp 10, however, would extinguish when a voltage below a predetermined operation voltage would be supplied.

The half-bridge circuit 50 receives said DC voltage having a large ripple. The half-bridge circuit 50 is configured to supply a high frequency AC current to the gas discharge lamp 10. The gas discharge lamp 10 is supplied with a high frequency AC current to prevent visible light flickering of the lamp 10.

The high frequency current is supplied to a load circuit comprising the resonant circuit 60 and the gas discharge lamp 10. The high frequency current supplied by the half-bridge circuit 50, however, varies in intensity with the low frequency of the ripple present in the DC voltage supplied to the half-bridge circuit 50. As a result, the current supplied by the half-bridge circuit 50 is periodically, i.e. with a frequency of the ripple frequency, too low to keep the gas discharge lamp 10 from extinguishing.

To prevent said extinguishing of the gas discharge lamp 10, the load circuit comprises the lamp 10 and the resonant circuit 60. When the lamp 10 threatens to extinguish, the resonant circuit 60 resonates such that a high voltage is generated in the load circuit, in particular a high voltage is generated over the lamp 10. Thereby, the generated high voltage prevents the lamp 10 from extinguishing.

FIG. 2 illustrates an embodiment of the gas discharge lamp driving circuit 20 according to the present invention. The input filter 30 is divided in two filter parts 30A and 30B. The first filter part 30A comprises a first input filter capacitance C1, an input filter transformer T1, and a second input filter capacitance C2. The first input filter capacitance C1 is connected between a first input terminal IN1 and a second input terminal IN2 of the input filter part 30A. The second input filter capacitance C2 is connected between a first output terminal OUT1 and a second output terminal OUT2 of the input filter part 30A. A first winding W1 of the input filter transformer T1 is connected between the first input terminal IN1 and the first output terminal OUT1 of the input filter part 30A. A second winding W2 of the input filter transformer T1 is connected between the second input terminal IN2 and the second output terminal OUT2 of the input filter part 30A.

The second input filter part 30B comprises a third input filter capacitance 30B and is provided after the rectifier circuit 40. The rectifier circuit 40 comprises four diodes D1-D4 in a full bridge configuration, which is well known in the art.

The half-bridge circuit and the load circuit comprising the resonant circuit and the gas discharge lamp 10 are indicated with reference numeral 80. The half-bridge circuit comprises two transistors Q1 and Q2, two diodes D5 and D6 and two capacitances C5 and C6. The resonant circuit comprises an inductance I1 and a capacitance C4. A control circuit for controlling the transistors Q1 and Q2 is not shown. The control circuit is connected to the gates G1 and G2 of said transistors Q1 and Q2, respectively.

The input filter 30 and the rectifier circuit 40 are circuits that are known in the art. It is noted that the capacitance C3 is a relatively small capacitance functioning as a low-pass filter and not as an energy storage capacitor. The capacitance C3 is intended to remove any high frequency part in the voltage output by the rectifier circuit 40.

The DC voltage output by the rectifier circuit 40 (and the input filter part 30B) is supplied to the half-bridge circuit 50. The control circuit connected to the gates G1 and G2 switches the transistors Q1 and Q2 one after the other on such that an AC voltage is generated between the load terminals L1 and L2. The AC voltage is thus generated over the load circuit comprising the resonant circuit 60 and the lamp 10. The frequency of the switching by the control circuit determines the frequency of the AC voltage over the load circuit.

In operation, i.e. when the lamp 10 is ignited, the AC current through the load circuit generates an arc in the gas discharge lamp 10. To keep the arc on, the voltage over the lamp 10 needs to higher than a predetermined operation voltage. Due to the ripple in the DC voltage supplied to the half-bridge circuit 50, the AC voltage output by the half-bridge circuit 50 periodically drops below said operation voltage.

When said AC voltage drops to practically zero, the lamp current drops to practically zero, thereby resulting in high impedance of the lamp 10. Due to the high lamp impedance, the damping of the load circuit has become less and as a result the resonant circuit will resonate strongly. Such a resonance of the resonant circuit sweeps up the voltage over the load circuit and in particular over the lamp 10, thereby preventing that the lamp 10 extinguishes.

The illustrated embodiment of the resonant circuit is a simple example of a suitable resonant circuit. The resonant circuit may be a more complex circuit, for example comprising an additional capacitance in series with the inductance I1. Such an additional capacitance enables to reduce the value of the first capacitance C4 in order to improve the power factor of the circuit, for example.

The frequency of the half-bridge circuit and the resonance frequency of the resonant circuit are tuned such that the resonance frequency is the same as said operating frequency or it may be a higher order odd harmonic of the operating frequency. Thus, the resonant circuit will resonate when the AC voltage has dropped below the operation voltage.

To ignite the gas discharge lamp 10, the half-bridge circuit starts operating at a frequency that is higher than the resonance frequency of the resonant circuit. Then, the operating frequency is lowered towards the resonance frequency until the operating frequency is close to the resonance frequency or a harmonic thereof as mentioned above. Supplying such a voltage and current to the resonant circuit leads to resonating of the resonant circuit. The resonating of the resonant circuit thereby generates enough voltage over the gas discharge lamp 10 to ignite the lamp 10. Thereafter, during operation, the half-bridge circuit keeps operating at said operating frequency.

FIGS. 3A-3C show a theoretical voltage V as a function of time t at a number of nodes in the lamp driving circuit according to the present invention. FIG. 3A shows an AC voltage output by the input filter having a mains voltage as input. The AC mains supply voltage is sinusoidal with a frequency of 50 Hz, for example. The input filter prevents high frequency signals from being transferred to the mains voltage source.

The DC voltage output by the rectifier circuit is shown in FIG. 3B. The frequency of the ripple in the DC voltage is twice the frequency of the sinusoidal frequency of the supplied AC voltage, thus the frequency of the ripple being 100 Hz. The half-bridge circuit receives the DC voltage shown in FIG. 3B and by high frequency switching the half-bridge circuit outputs the voltage shown in FIG. 3C. The output voltage is a high frequency alternating voltage having an sinusoidal low-frequency envelop corresponding to the sinusoidal frequency of the supplied AC voltage shown in FIG. 3A.

The voltages shown in FIGS. 3A-3C are theoretical, meaning that they may be different dependent on the load circuit connected to the half-bridge circuit. Also non-ideal characteristics of the components used in the circuits may influence the actual shape and value of the voltages shown in FIGS. 3A-3C.

FIG. 4 shows a measured gas discharge lamp current I1 and lamp voltage V1 in an embodiment of the present invention as a function of time t. Due to the high frequency of the signals, the actual signal is not distinguishable anymore, but only the envelope is visible (see also FIG. 3C). The signals I1 and V1 are acquired using a 50 HZ mains voltage, and as may be expected the shown lamp current envelope has a frequency of 100 Hz and a substantially sinusoidal shape.

The shown lamp voltage envelope does not have a sinusoidal shape. At a zero crossing t1 of the sine wave of the lamp current I1, the envelope of the voltage V1 is substantially zero. Then, the resonant circuit sweeps up the voltage V1 and the lamp ignites. As the lamp ignites, the lamp current I1 starts running. With a current running through the lamp, the resonant circuit is damped and the voltage V1 drops to a predetermined level which level is still above an operating voltage level of the lamp. When the lamp current I1 becomes zero again, the lamp voltage V1 drops to zero, stimulating the resonant circuit, thereby starting a new period.

FIG. 5 shows the same lamp voltage V1 as shown in FIG. 4. Further, FIG. 5 shows a current Ii running through the inductance of the resonant circuit in the load circuit of the embodiment shown in FIG. 2. The shown time scale is identical to the time scale of FIG. 4. The lamp voltage V1 is shown on a smaller scale, but is also identical to the one shown in FIG. 4.

The inductance current Ii clearly differs from the lamp current I1 at the beginning and the end of the sine wave. The current Ii through the coil is swept up, when the current I1 through the lamp is substantially zero, due to the resonance in the circuit. This resonance effect is employed to prevent that the lamp extinguishes.

The gas discharge lamp driving circuit according to the present invention disclosed herein is in particular suitable for driving a high intensity gas discharge (HID) lamp. Especially intensive applications of lamps, such as horticultural applications, may benefit from the disclosed lamp driving circuit because of the high efficiency of the driving circuit.

The above-described and illustrated embodiments are simple and energy-efficient. The present invention is however not limited to the illustrated embodiments and it will be apparent to those skilled in the art how the above embodiments may be altered without departing from the scope of the invention. For example, the high frequency half-bridge circuit may be replaced by a full bridge circuit, and the input filter circuit may be replaced by any other low-pass filter suitable for filtering high frequency signals from the supply voltage.

In the above description as well as in the appended claims, 'comprising' is to be understood as not excluding other elements or steps and 'a' or 'an' does not exclude a plurality. Further, any reference signs in the claims shall not be construed as limiting the scope of the invention.

The invention claimed is:

1. Method for driving a gas discharge lamp (10), comprising providing an AC supply voltage to a rectifier circuit (40), the rectifier circuit (40) outputting a double sided rectified voltage;

providing a high frequency control signal to a high frequency bridge circuit (50);

providing said double sided rectified voltage to said high frequency bridge circuit (50), the bridge circuit (50) outputting a high frequency bridge output voltage; and providing said bridge output voltage to a load circuit comprising the gas discharge lamp (10) and a resonant circuit (60);

wherein the frequency of the bridge output voltage is controlled such that during steady-state operation of the gas discharge lamp (10) said resonant circuit (60) resonates to sweep up the voltage supplied to the gas discharge lamp (10) to a voltage higher than a predetermined ignition voltage each time the bridge output voltage is lower than a predetermined operation voltage.

2. Method according to claim 1, further comprising filtering said AC supply voltage by a low-pass input filter circuit (30).

3. Method according to claim 1, wherein the frequency of the bridge output voltage is swept downwards to a resonance frequency of said resonant circuit (60), or a harmonic of said resonance frequency, to sweep up the voltage supplied to the gas discharge lamp (10) in order to ignite the gas discharge lamp (10).

4. Method according to claim 1, wherein the resonance frequency of the resonant circuit (60) is a first or odd higher order harmonic of the frequency of the bridge output voltage.

5. Single stage gas discharge lamp driving circuit (20) for driving a gas discharge lamp (10), the circuit (20) comprising:

a rectifier circuit (40) for rectifying an AC supply voltage;

a high frequency bridge circuit (50), input terminals of the bridge circuit being connected to output terminals of said rectifier circuit (40) for receiving a double sided rectified voltage;

a control circuit for supplying a high frequency control signal to said bridge circuit (40); and a load circuit comprising a gas discharge lamp (10) and a resonant circuit (60), the load circuit being connected to said bridge circuit (50) for receiving a high frequency bridge output voltage;

wherein the frequency of the bridge output voltage is controlled by the control circuit such that during steady-state operation of the gas discharge lamp (10) said resonant circuit (60) resonates to sweep up the voltage supplied to the gas discharge lamp (10) to a voltage higher than a predetermined ignition voltage each time the bridge output voltage is lower than a predetermined operation voltage.

6. Single stage gas discharge lamp driving circuit (20) according to claim 5, the driving circuit (20) further comprising a low-pass input filter (30) for filtering high frequency signals, input terminals of said rectifier circuit (40) being connected to output terminals (OUT1, OUT2) of said input filter (30) for receiving a filtered AC supply voltage.

7. Single stage gas discharge lamp driving circuit according to claim 6, wherein the low-pass input filter (30) comprises a first input filter capacitance (C1), an input filter transformer (T1), and a second input filter capacitance (C2), the first input filter capacitance (C1) being connected between a first and a second input terminal (IN1, IN2) of the input filter (30) and the second input filter capacitance (C2) being connected between a first and a second output terminal (OUT1, OUT2) of the input filter (30), a first winding (W1) of the input filter transformer (T1) being connected between the first input terminal (IN1) and the first output terminal (OUT1) of the input filter (30), and a second winding (W2) of the input filter transformer (T1) being connected between the second input terminal (IN2) and the second output terminal (OUT2) of the input filter (30).

8. Single stage gas discharge lamp driving circuit according to claim 5, wherein the load circuit comprises a parallel circuit of the gas discharge lamp (10) and a first capacitance (C4), which parallel circuit is connected in series with an inductance (I1), the capacitance (C4) and the inductance (I1) being part of said resonant circuit (60).

9. Single stage gas discharge lamp driving circuit according to claim 8, wherein a second capacitance is connected in series with said inductance (I1) and said parallel circuit.

* * * * *